US006099333A

United States Patent [19]

Daoud et al.

[11] Patent Number: 6,099,333

[45] Date of Patent: Aug. 8, 2000

[54] CUSTOMER BRIDGE WITH AUTOMATIC CONNECT AND DISCONNECT FEATURES

[75] Inventors: Bassel Hage Daoud, Parsippany; Christopher M. Helmstetter, Bridgewater, both of N.J.

[73] Assignee: Lucent Technologies Inc., Murray Hill, N.J.

[21] Appl. No.: 09/109,272

[22] Filed: Jun. 30, 1998

[51] Int. Cl.[7] ..... H01R 29/00

[52] U.S. Cl. ..... 439/188; 200/51.1

[58] Field of Search ..... 439/188; 200/51.1

[56] References Cited

U.S. PATENT DOCUMENTS 5,030,123 7/1991 Silver ..... 439/188
5,178,554 1/1993 Siemon et al. ..... 439/188
5,704,797 1/1998 Meyerhoefer et al. ..... 439/188

*Primary Examiner*—Renee Luebke
*Assistant Examiner*—T. C. Patel
*Attorney, Agent, or Firm*—Howard C. Miskin; Gloria Tsui-Yip

[57] ABSTRACT

A network interface device is disclosed that connects a plug of a telephone test equipment to the telephone lines of the central office of a telephone service supplier, while at the same time disconnects customer's telephone lines from the telephone lines of the central office. Conversely, when the plug of the telephone test equipment is removed, the customer's telephone lines are reconnected to the telephone lines of the central office. The connection/disconnection is accomplished simultaneously by the insertion of the plug of the telephone test equipment into the cavity of a jack of the network interface device.

12 Claims, 3 Drawing Sheets

CUSTOMER BRIDGE WITH AUTOMATIC CONNECT AND DISCONNECT FEATURES

BACKGROUND OF THE INVENTION 1.0 Field of the Invention

The invention relates to an interface device for a telephone network that is used for testing the functionality of the telephone service supplier's telephone lines and, more particularly, to a network interface device that connects a telephone test instrument to the telephone lines of the central office.

2.0 Description of Related Art

Telephone networks are constantly increasing due to the ever increasing demands of the general public, as well as the demands of commercial and industrial establishments. Because of the enormity of the telephone networks, telephone equipment failures, as well as telephone lines servicing data communication equipment such as facsimile equipment and computers, sometimes occur, and because of the importance of these interconnected devices, these failures must be quickly localized and corrected.

Network interface devices for telephone networks are used in the functional testing of telephone service supplier's lines (versus telephone lines located within a building, which are usually maintained by the customers, and/or by the customers' telephone equipment supplier). The network interface device is typically located at a junction box where the lines from the telephone service supplier enter and are distributed throughout the building.

Network interface devices are known and one such device is commonly called a customer bridge. The customer bridge is located in the junction box and comprises a plug (male) and jack (female) mating arrangement in which the plug is connected, via cabling and wire wrap connections, to the customers' telephone lines. When the jack and plug are mated together, the customer bridge creates a continuous circuit between the central office and the customer's equipment. When a customer experiences a problem with the telephone lines, the customer can go to the junction box where the customer bridge is connected to test if the problem is with the telephone service supplier's lines or the telephone lines in the building of the customer. Underwriters Laboratories (UL) regulations require that anyone working on telephone lines at a junction box, such as the telephone lines associated with the customer bridge, create an open circuit, as presented to the customers' equipment, before even attempting to work on the telephone lines.

The customer bridge device is designed to require the removal of the plug from its mating with the jack, thereby opening the connection of the telephone lines of the telephone service supplier to the customer's telephone lines. The plug of the customer bridge must be disconnected before the associated plug of the test equipment is plugged in so as to check for the operation of the telephone lines of the central office of the telephone service supplier. Once the plug of the test equipment is installed, typically, if a dial tone is detected it signifies that the lines from the central office of the telephone service supplier to the building of the customer are working and the problem is in the telephone lines and/or equipment within the customer's building. Although the customer bridge serves well its intended purpose, it does suffer the disadvantage of requiring a plug, along with cabling and wire-wrap connections, for interconnecting the customers' telephone lines which increase the cost of the customer bridge device and increase the chance of inadvertent malfunction.

Another problem associated with the customer bridge commonly occurs when a customer works on telephone wires, e.g., to remove, clean or repair telephone wires. More particularly, the customer bridge is commonly utilized and it is done so without disconnecting the plug of the customer bridge despite posted warning of such an undesired operation. It is desired that means be provided that disconnects the telephone lines of a customer from the telephone lines of the telephone service supplier during testing of those lines without relying on the need of any separate and affirmative removal of the plug of the customer bridge by the customer.

Therefore, there is a need for a network interface device that eliminates a plug, cabling and wire wrap connections for interfacing the customer lines to the telephone lines of the central office of the telephone service supplier.

Further, there is a need for a device that responds to the insertion therein of an associated plug of the telephone test equipment to automatically disconnects the customer telephone lines from the telephone lines of the central office of the telephone service supplier and, conversely, responds to the removal therefrom of the associated plug of the telephone test equipment to automatically connects the telephone lines of the customer to the telephone lines of the central office.

SUMMARY OF THE INVENTION

The present invention is directed to a device that is particularly suited for telephone network interface that connects a telephone test instrument to the telephone lines of the central office of the telephone service supplier, while at the same time disconnects the customers' telephone lines to the central office of the telephone service supplier, thereby, electrically isolating the interface between the customer and telephone service supplier for test and trouble-shooting purposes. Further, the telephone lines of the customer are reconnected to the central office when the telephone test instrument is removed from the device.

The interface device connects a plug of a test instrumentation to input lines of a service supplier while simultaneously disconnecting the input lines of the supplier from output lines connected to the input lines and reconnects the telephone lines of the customer to the input lines of the supplier when the plug of the test instrument is removed from the interface device. The plug of the test instrumentation carries one or more electrically conductive members, each member having first and second ends with the first end being interconnected to the test instrumentation.

The interface device comprises an electrical conductive test instrumentation connecting device for interconnecting with a mating connection of test instrumentation. The electrical conductive test instrumentation connecting device simultaneously disconnects the service lines from the customer lines and connects the test instrumentation to the service lines in response to the connecting device interconnecting with the mating connection of the test instrumentation, and simultaneously connects the customer lines to the service lines and disconnects the test instrumentation from the service lines in response to the disconnecting of the mating connection from the test instrumentation from the interface device electrical conductive instrumentation connecting device.

The interface device comprises one or more flexible electrically conductive members, each having first and second ends with the first end being connected to the input lines of said service supplier. The second end of the conductive members frictionally contacting a mating surface. The one or more flexible electrically conductive members are housed in a cavity dimensioned complementary to the plug of the test instrumentation to receive the plug. The conductive members being positioned in the cavity and aligned to contact corresponding ones of the electrically conductive members of the plug, when the plug is inserted into the cavity. The frictional contact by the second end of said flexible electrically conductive members being moved from a respective first position to a respective second position in response to the plug being inserted into the cavity.

The interface device further comprises one or more electrically conductive paths, each having first and second ends, with the first end being connected to said output lines. The second end of the electrically conductive path positioned to electrically connect with the second end of the flexible electrically conductive member in the first position, but not in the respective second position.

DETAILED DESCRIPTION OF THE PREFERRED EMBODIMENTS

Figure 1:
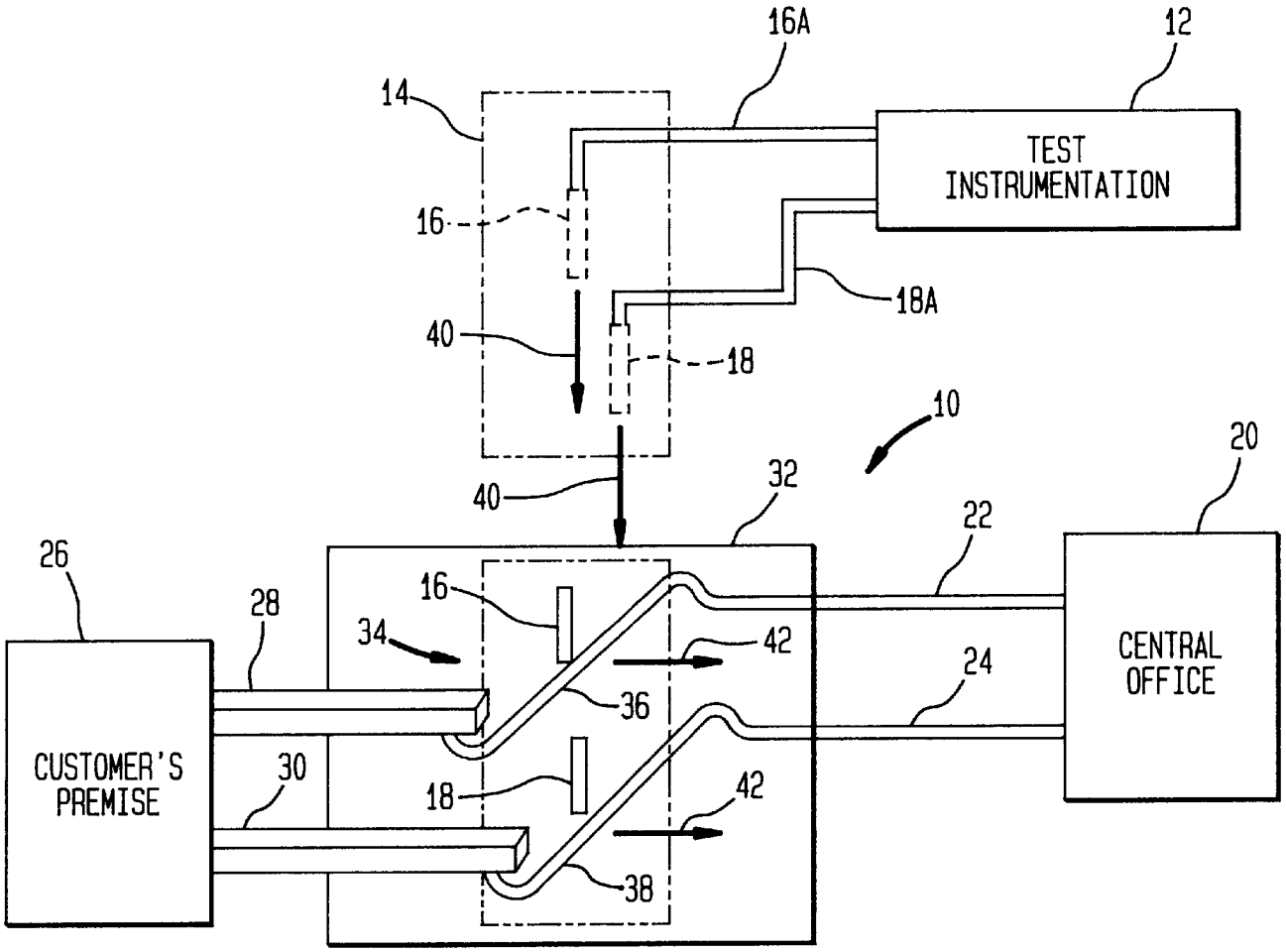
FIG. 1 is a schematic generally illustrating the principles of operation of the present invention.

Referring now to the drawings, wherein the same reference number indicates the same element throughout, there is shown in FIG. 1 a schematic generally illustrating the principles of operation of the network interface device 10 of the present invention. Although the description to be given is primarily related to telephone equipment, the practice of this invention is applicable to all types of communication networks that are interconnected by the mating of electrical connectors.

The network interface device 10 interfaces test instrumentation 12, which has a plug 14 (male) with exposed electrically conductive members 16 and 18, to the central office 20 of a telephone service supplier. The conductive members 16 and 18 are connected to the test instrumentation 12 by way of conductors 16A and 18A, respectively, which preferably are telephone lines known in the art.

In one embodiment, the network interface device 10 electrically connects the conductors 16 and 18 of plug 14 to the telephone lines 22 and 24 of the central office 20 of the telephone service supplier, while at the same time simultaneously by the insertion of plug 14 into the network interface device 10 automatically disconnects the telephone lines 22 and 24 from the customer's premise 26 who is receiving telephone service from the telephone service supplier. More particularly, the network interface device 10 in response to the plug 14 being inserted into the network interface device 10 automatically and positively disconnects the telephone lines 22 and 24 from the conductive paths 28 and 30 of the network interface device 10 which are electrically connected to corresponding telephone lines 28B and 30B (to be described with reference to FIGS. 2 and 3) of the customer's premise 26, when work or verifying connections on output lines is being conducted at an associated junction box. Further, the network interface device 10 in response to the removal of plug 14 from the network interface device 10 automatically connects the telephone lines 28B and 30B to the telephone lines 22 and 24 of the central office 20.

The network interface device 10 has a connecting device, such as a jack 32 (female) having a cavity 34 that has predetermined dimensions which are complementary to the dimensions of the plug 14 so as to preferably accommodate a snug insertion thereof. The cavity 34 comprises electrical conductive test instrumentation connecting device and the plug 14 comprises a mating connection of the test instrumentation 12.

The network interface device 10 has flexible electrically conductive members 36 and 38 each having first and second ends with the first end being configured so as to be connected to the telephone lines 22 and 24 of the central office 20. The flexible electrically conductive members 36 and 38 each has a second end which is configurated, such as being a bent hooked shape end, for providing compressive frictional contact with a mating surface. More particularly, the flexible electrically conductive members 36 and 38 are configured for providing frictional contact to the undersurface of the electrically conductive paths 28 and 30 respectively. As generally known in the art, conductive paths 28 and 30 may be a thin sheet of copper on a printed wiring board. Although FIG. 1 illustrates two exposed electrical conductive members 16 and 18 and two flexible electrically conductive members 36 and 38, the practice of this invention more completely contemplates the usage of one or more exposed electrical conductors operatively cooperating with one or more flexible electrically conductive members.

In operation, when the plug 14 is grasped and inserted in direction 40 from its at-rest position (shown in phantom), the plug 14 moves into the cavity 34 so that the electrically conductive members 16 and 18 come into direct contact with the flexible electrically conductive members 36 and 38, respectively. The flexible electrically conductive members 36 and 38 in response to the plug 14 insertion are moved in a lateral manner, as viewed in FIG. 1, and as indicated by directional arrows 42 and, furthermore, so that the frictional engagement between the flexible electrically conductive members 36 and 38 with electrically conductive paths 28 and 30 are dragged along and then moved away from the contact therebetween and allow the flexible electrically conductive members 36 and 38 to be physically and electrically separated from conductive paths 28 and 30 respectively. Conversely, because of the spring nature of the conductive members 36 and 38, when the plug 14 is removed from the interface network device 10, the electrically conductive paths 28 and 30 are reconnected to the conductive members 36 and 38.

Although the insertion direction 40 for the plug 14 is shown in a downward manner in FIG. 1, it should be realized that the plug 14 could be inserted in any manner so long as the exposed conductive members 16 and 18 come into direct contact with flexible electrically conductive members 36 and 38 within the cavity 34 causing the movement thereof from the electrical conductive paths 28 and 30 respectively. The network interface device 10, along with its operative cooperation with the plug 14 of the test instrumentation 12, may be further described with reference to FIGS. 2 and 3.

Figure 2A:
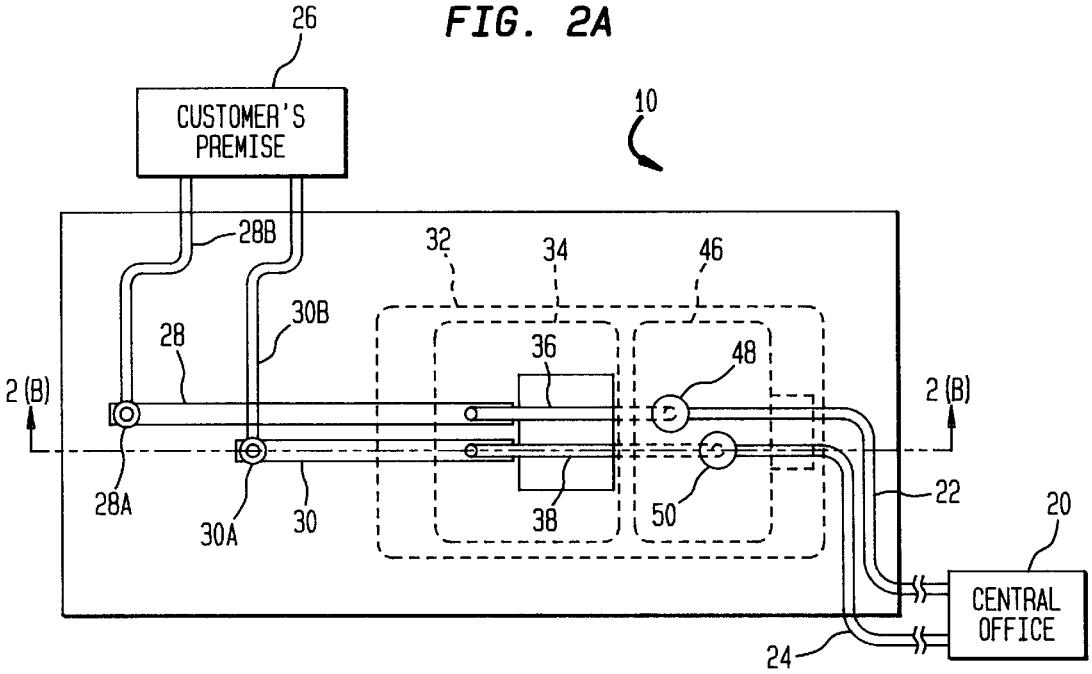
FIG. 2 is composed of FIGS. 2(A) and 2(B) which are respectively a bottom view and a side view, with the side view taken along line 2(B)—2(B) of FIG. 2(A), of the network interface device of the present invention.
Figure 2B:
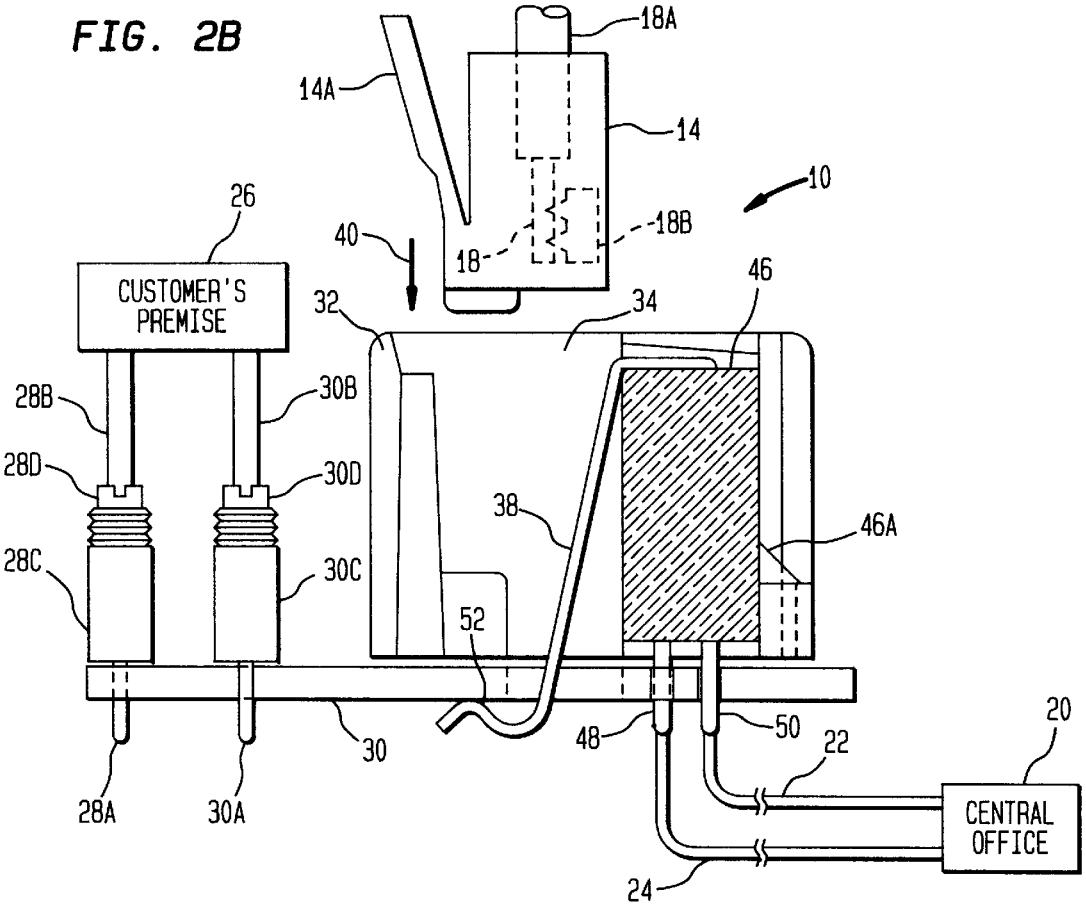

FIG. 2 is composed of FIGS. 2(A) and 2(B), wherein FIG. 2A is a bottom view of the network interface device 10 and FIG. 2(B) is a side view of the network interface device 10 taken along line 2(B)—2(B) of FIG. 2(A). FIG. 2(A) illustrates the electrically conductive path 28 associated with the customer's premise 26 as further comprising a pin 28A and a telephone line 28B, whereas the electrically conductive path 30 associated with the customer's premise 26 further comprises a pin 30A and the telephone line 30B. FIG. 2(A) further illustrates that the flexible electrically conductive members 36 and 38 are respectively connected to the conductors 22 and 24 by a connector 46 having pins 48 and 50 respectively. The connector 46 is preferably a type 645 Insert known in the telephone art. Similarly, the plug 14 may be a RJ11 plug and the jack 32 may be a RJ11 jack, both known in the telephone art. Further, the plug 14 preferably has a snap-lock arm 14A, known in the telephone art. Further still, the telephone lines 22, 24, 28B and 30B are preferably confined by respective cables in a manner known in the telephone art. Moreover, the flexible electrically conductive members 36 and 38 are preferably formed of a springy electrically conductive material, known in the telephone art.

From FIG. 2(A) it is seen that the telephone lines 28B and 30B of the customer's premise 26 are directly connected to the telephone lines 22 and 24 of a central office by way of the conductive paths 28 and 30, the flexible electrically conductive members 36 and 38, the pins 48 and 50, and electrically conductive paths 22 and 24 of the central office 20. Conductive paths 28 and 30 are in planar alignment with flexible conductive members 36 and 38 respectively and each corresponding pair of conductive path 28 (or 30) and conductive member 36 (or 38) lie on the same plane (best shown in cross-sectional view 2(B)). This direct electrical path between the customer's premise 26 and the central office 20 is open circuited in a manner to be described hereinafter with reference to FIG. 3(A). The electrical path between the customer's premise 26 and the central office 20 may be further described with reference to FIG. 2(B).

FIG. 2(B) further illustrates that the telephone lines 28B and 30B are preferably connected to stand-offs 28C and 30C respectively. The stand-offs 28C and 30C connect to the telephone lines 28B and 30B, respectively, by screw-type connections 28D and 30D respectively. FIG. 2(B) further illustrates that the flexible electrically conductive member 38 is compressively and frictionally engaged to the electrically conductive path 30 at location 52. The hook shape end of conductive member 38 advantageously contacts conductive path 30 at a distance away from the edge of the conductive path 30 at location 52 (best shown in FIG. 2(A)). It should be noted that because of the side view of the network interface device 10 of FIG. 2(B) is taken along line 2(B)—2(B) of FIG. 2(A), the exposed electrically conductive member 16 and the flexible electrically conductive member 36 are not shown in FIG. 2(B) (nor FIG. 3(A)), but the descriptions to be given for exposed electrically conductive member 18 and the flexible electrically conductive member 38 are applicable to elements 16 and 36 respectively.

Further, FIG. 2(B) illustrates a typical plug 14, wherein its electrical conductive member 18 has an engaging member 18B that comes into direct contact with the flexible electrically conductive member 38 and also has a telephone line 18A (also shown in FIG. 1) connected thereto. FIG. 2(B) illustrates the plug 14 in its non-inserted position relative to the jack 32 having the cavity 34 that is dimensioned to preferably accommodate a snug fit insertion of the plug 14. Further, it should be noted in FIG. 2(B) that the flexible electrically conductive member 38 extends into and beyond the cavity 34 so as to be lined up and come into contact with the engaging member 18B when the plug 14 i s inserted into the cavity 34 of the jack 32. The electrical mating of the exposed conductor 18, in particular the engaging member 18B, to the flexible electrically conductive member 38 may be further described with reference to FIG. 3.

Figure 3A:
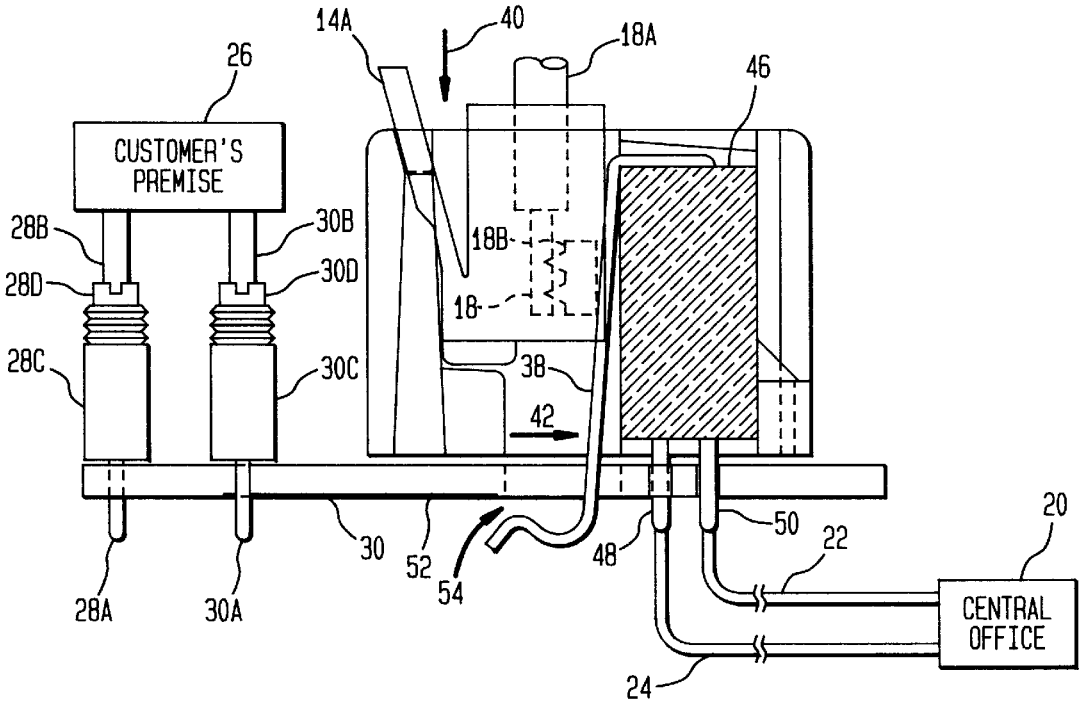
FIG. 3 is composed of FIGS. 3(A) and 3(B) which are respectively a side view and a bottom view of the network interface device with the side view taken along line 3(A)—3(A) of FIG. 3(B).
Figure 3B:
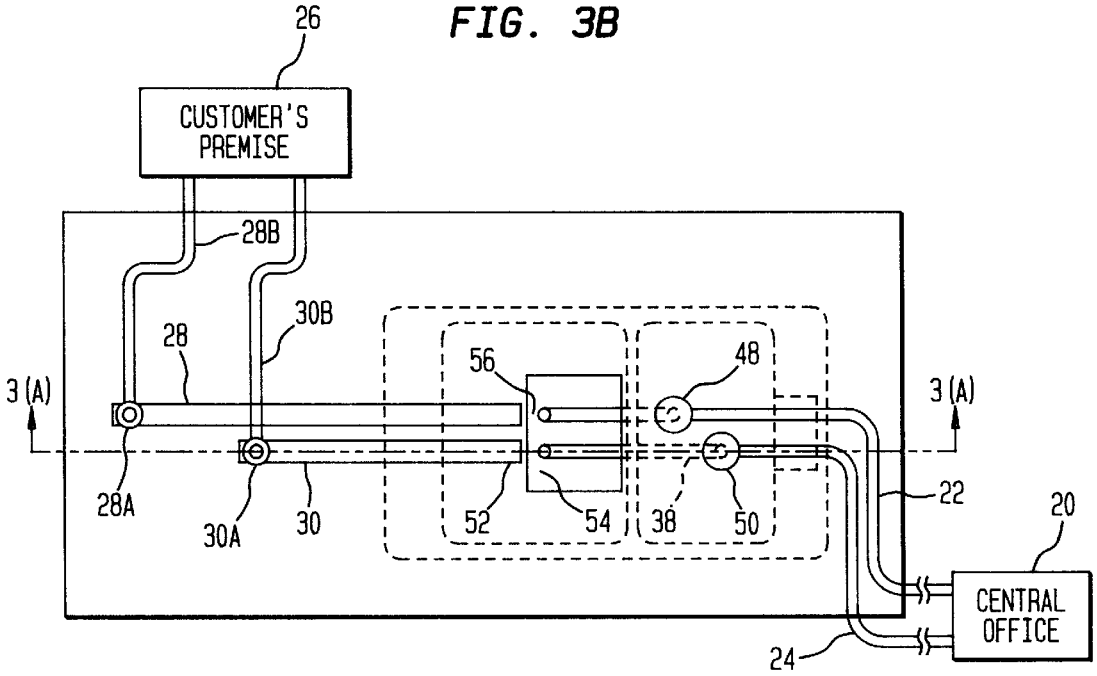

FIG. 3 is similar to FIG. 2 except that FIG. 3(A) is a side view of the network interface device 10 taken along lines 3(A)—3(A) of FIG. 3(B). FIG. 3(A) illustrates the condition of the jack 14 after it has been inserted, in the direction 40 described with reference to FIG. 1, into the cavity 34. A comparison between FIG. 2(B) and 3(A) reveals that the flexible electrically conductive member 38 of FIG. 3(A) has laterally moved relative to FIG. 2(B) so that the frictional contact between the flexible electrically conductive member 38 and the electrically conductive path 30 at the first location 52 is no longer present, but rather a second position is established forming a gap 54 between the flexible electrically conductive member 38 and the electrically conductive path 30.

The gap 54 illustrates that the electrical continuity between the electrical path 30 and the electrically conductive path 22 no longer exists. This gap 54 was established because the plug 14, in particular, the engaging member 18B was affirmatively brought into contact with the flexible conductive member 38, thereby, causing the flexible electrically conductive member 38, in particular, the frictional engaging portion end of member 38, to be moved laterally, indicated by direction 42, from the first position 52 (see FIG. 2(B)) to the second position establishing the gap 54 (see FIG. 3(A)). The operative cooperation between plug 14 and flexible electrically conductive members 36 and 38 was previously described with reference to FIG. 1. The break in the electrical conductivity between the customer's telephone line 28B and 30B and the telephone lines 22 and 24 of the central office 20 may be further described with reference to FIG. 3(B).

From FIG. 3(B) it is seen that the gap 54 exists between the electrically conductive path 30 and the flexible electrically conductive member 38, as well as a corresponding gap 56 exists between the electrically conductive path 28 and the flexible electrically conductive member 36. Accordingly, the mere insertion of the plug 14 of the test instrumentation 12 not only causes the electrical connection between the conductors 16 and 18 to telephone lines 22 and 24 of the central office 20 but also at the same time, causes the disconnect of the telephone lines 22 and 24 from the telephone lines 28B and 30B of the customer's premise 26. Further, the mere removal of the plug 14 causes the telephone lines 28B and 30B to be automatically reconnected to the telephone lines 22 and 24 of the central office 20.

It should now be appreciated that the practice of the present invention provides for an interface device that allows for the mere insertion of a telephone plug of an instrumentation equipment to connect the instrumentation equipment to the telephone lines with the central office so as to supply the testing thereof. Unlike prior art devices, the practice of the present invention does not rely upon the need of an operator to physically remove a plug that is connected to the customer's premise in order to perform safe and necessary testing of the equipment associated with the central office of the telephone service provider.

The present invention provides for a network interface device that not only performs the desired electrical interconnections for testing of the telephone service supplier lines, but does such in a very cost-effective manner.

It is contemplated that the practice of this invention extends to all types of communication networks supported by interconnections some of which need to be broken or open circuited when test equipment is mated thereto, while other interconnections need to be maintained with the test equipment for testing purposes. The principles of this invention may be applied to the electrical connectors that provide the interconnections between the equipment comprising the communication networks.

Although certain features of the invention have been illustrated and described herein, better modifications and changes will occur to those skilled in the art. Additionally, while the main embodiment is described with respect to telephone lines, other electrical connections are equally well adapted to use this invention. It is, therefore, to be understood that the appended claims are intended to cover all such modifications and changes that fall within the spirit of the invention.

What we claim is:

1. An interface device for selectively and simultaneously connecting and disconnecting lines of a service supplier with lines of a customer via their respective conductive paths, said device comprising: an electrical conductive test instrumentation connecting device comprising a cavity and at least one flexible electrically conductive member in the same plane as its corresponding customer line conductive paths external to said cavity for interconnecting with a mating connection of a test instrumentation, each of said conductive members having first and second ends and a middle portion with said first end being connected to the service lines and said second end having a bent hook shape extending beyond said cavity and being selectively connected and disconnected to the customer lines, said conductive member simultaneously disconnecting the service lines from the customer lines and connecting the test instrumentation to the service lines in response to said middle portion of said conductive member interconnecting with said mating connection of the test instrumentation, and simultaneously connecting the customer lines to the service lines and disconnecting the test instrumentation from the service lines in response to the disconnecting of said mating connection of said test instrumentation from said middle portion of said conductive member.

2. The interface device according to claim 1, wherein said flexible electrically conductive member is comprised of a spring electrically conductive material.

3. The interface device according to claim 1, wherein said mating connection of said test instrumentation is a plug.

4. The interface device according to claim 3, wherein said jack and said plug are both RJ11 types.

5. The interface device according to claim 1, wherein said customer and supplier lines are telephone lines.

6. An interface device for selectively connecting a plug of a test instrumentation to input lines of a service supplier while simultaneously disconnecting the input lines of the supplier from output lines connected to said input lines, said plug of said test instrumentation carrying one or more electrically conductive members, each member having first and second ends with said first end being interconnected to said test instrumentation, said interface device comprising:

a cavity having a first and second end and being dimensioned complementary to said plug of said test instrumentation to receive said plug;

one or more flexible electrically conductive members being housed in said cavity, each having first and second ends with the first end being connected to said input lines of said service supplier, said second end of each of said conductive members having a bent hook shape extending beyond said second end of said cavity and resiliently urged to electrically contact a mating surface, said flexible electrically conductive members being positioned in said cavity and aligned to contact corresponding ones of said electrically conductive members of the plug in response to the plug being inserted into said first end of said cavity, said resilient contact by said second end of said flexible electrically conductive members being moved from a respective electrical contact first position to a respective non-contact second position in response to said plug being inserted into said cavity; and one or more electrically conductive paths external to said cavity, each having first and second ends with said first end being connected to said output lines, said second end of said electrically conductive path positioned to electrically connect with said second end of said flexible electrically conductive member in said first position, but not in the respective second position.

7. The interface device according to claim 6, wherein said flexible electrically conductive members are comprised of a springy electrically conductive material.

8. The interface device according to claim 6, wherein said cavity is housed in a jack.

9. The interface device according to claim 8, wherein said plug and said jack are both RJ11 types.

10. The interface device according to claim 6, wherein said output lines are connected to a customer of said supplier.

11. The interface device according to claim 10, wherein said interface device further comprises second output lines associated with said supplier and connected to said first end of said one or more flexible electrically conductive members.

12. The interface device according to claim 6, wherein said input and output lines are telephone lines.

* * * * *